US008021082B2

(12) United States Patent
Thomas et al.

(10) Patent No.: US 8,021,082 B2
(45) Date of Patent: Sep. 20, 2011

(54) SUCTION PILE SUITABLE FOR SHALLOW DEPTHS

(75) Inventors: Pierre-Armand Thomas, Puteaux (FR); A. Brian Roberts, London (GB)

(73) Assignee: Technip France (FR)

( * ) Notice: Subject to any disclaimer, the term of this patent is extended or adjusted under 35 U.S.C. 154(b) by 279 days.

(21) Appl. No.: 12/374,738

(22) PCT Filed: Jul. 16, 2007

(86) PCT No.: PCT/FR2007/001213

§ 371 (c)(1),
(2), (4) Date: Jan. 22, 2009

(87) PCT Pub. No.: WO2008/012414

PCT Pub. Date: Jan. 31, 2008

(65) Prior Publication Data

US 2010/0021241 A1 Jan. 28, 2010

(30) Foreign Application Priority Data

Jul. 27, 2006 (FR) ..... 06 06882

(51) Int. Cl.
*E02D 7/20* (2006.01)

(52) U.S. Cl. ..... 405/224.1; 114/296

(58) Field of Classification Search ..... 114/294–296; 405/224, 224.1, 226, 228
See application file for complete search history.

(56) References Cited

U.S. PATENT DOCUMENTS 4,575,282 A * 3/1986 Pardue et al. ..... 405/228

FOREIGN PATENT DOCUMENTS

CH 299 642 A 6/1954
DE 103 24 161 A1 12/2004

OTHER PUBLICATIONS

International Search Report dated Jan. 22, 2008, issued in corresponding international application No. PCT/FR2007/001213.

* cited by examiner

*Primary Examiner* — Sunil Singh
(74) *Attorney, Agent, or Firm* — Ostrolenk Faber LLP

(57) ABSTRACT

A suction pile comprising a cylindrical wall and a piston that is movable inside the cylindrical wall. The cylindrical wall has one suction end suitable for sinking into an ocean floor. The piston delimits two chambers, one being able to be filled with water. The suction pile includes a pump for extracting the water from the one chamber and for causing the sinking of the suction end. The pump comprises a device for stopping the piston while the cylindrical wall has one water intake end to allow water to enter into the other chamber. The piston is alternatively stopped and driven in movement as the suction end sinks.

8 Claims, 2 Drawing Sheets

SUCTION PILE SUITABLE FOR SHALLOW DEPTHS

CROSS REFERENCE TO RELATED APPLICATION

The present application is a 35 U.S.C. §§371 national phase conversion of PCT/FR2007/001213, filed 16 Jul. 2007, which claims priority of French Application No. 0606882, filed 27 Jul. 2006. The PCT International Application was published in the French language.

BACKGROUND OF THE INVENTION

The present invention relates to a suction pile designed to be sunk into a seabed, in particular into a seabed of shallow depth.

Suction piles make it possible to anchor installations or structures in the seabed in order to hold them in a fixed position. These well known suction piles comprise a cylindrical wall and, inside, a partition which divides the cylindrical wall into two chambers that are sealed relative to one another. The cylindrical wall then has an open suction end suitable for being pressed against the seabed so as to close off one of said chambers. This chamber is then filled with water and pumping means are suitable for extracting the water from said chamber in order to create a negative pressure therein and cause the cylindrical wall to sink into the seabed. Therefore, gradually as the pumping takes place, the cylindrical wall sinks into the seabed and the suction pile is then anchored therein.

Reference may notably be made to document U.S. Pat. No. 6,488,446 which describes suction piles of the aforementioned type, in which said partition which divides the cylindrical wall into two chambers can be moved for the purpose of increasing the volume of the other chamber which is totally sealed and which makes it possible to increase the buoyancy notably of the suction pile. These technical features are designed to make said suction piles easier to transport.

Furthermore, the sinking of the cylindrical wall into the seabed is easier if the depth of said seabed is great. Specifically, the hydrostatic pressure which increases with the depth helps to apply forces to the suction pile, which forces promote its sinking.

However, at shallow depths, for example less than 50 meters, the forces that are applied to the top end of the suction pile which, for example, has a length of 15 meters, are relatively weak since they are related to the hydrostatic pressure that then prevails at a depth of 35 meters.

Therefore, a problem that arises and that the present invention aims to solve is making it easier for the suction piles to penetrate seabeds of shallow depth.

SUMMARY OF THE INVENTION

For the purpose of solving this problem, the present invention proposes a suction pile designed to be sunk into a seabed. The seabed is surmounted with water. The water has a seabed hydrostatic pressure in the vicinity of the seabed. The suction pile comprises a cylindrical wall and a piston that can move inside the cylindrical wall. The cylindrical wall has an open suction end suitable for being sunk into said seabed. The piston delimits in a sealed manner two opposite chambers. One of the chambers extends between the suction end, and the piston being capable of being filled with water when the suction end is placed against the seabed. The suction pile also comprises a pump for extracting the water contained in the one of the chambers and causing the open suction end to sink into the seabed. The suction pile has a device for immobilizing the piston relative to the cylindrical wall, while the cylindrical wall has a water-entry end opposite to the suction end relative to the piston, in order to allow the entry of water at hydrostatic pressure into the other chamber. The piston is alternatively immobilized and made to move from the suction end to the water-entry end gradually as the open suction end is sunk in, so that the piston is subjected to the seabed hydrostatic pressure and causes the suction end to sink into the seabed.

Therefore, one feature of the invention lies in bringing the other chamber, opposite to the suction chamber, to hydrostatic pressure. It also lies in the method of interaction of the piston and the cylindrical wall, which are alternately immobilized relative to one another gradually as the cylindrical wall sinks into the seabed. In this way, the piston is initially moved toward the open suction end and it is immobilized at a distance from the latter, so as to produce a suction chamber filled with water. Therefore, the cylindrical wall extends vertically on the seabed, and the piston situated in the vicinity of the seabed is then subjected to the seabed hydrostatic pressure, since the water-entry end has allowed the cylindrical wall to fill. In this manner, the piston, which is immobilized relative to the cylindrical wall, transmits thereto the forces that it sustains from the hydrostatic pressure, and which are applied vertically to the seabed. Consequently, the combined forces of the suction of the water of the suction chamber and the aforementioned forces on the cylindrical wall allow more rapid sinking of the suction pile. Clearly, gradually as the cylindrical wall sinks into the seabed and as the water of the suction chamber is sucked out, the sediments of the seabed rise into the suction chamber and then come against the piston. Therefore, the initially immobilized piston is then released and moved toward the water-entry end for a certain distance while allowing water to enter the suction chamber in order subsequently to be immobilized again in the vicinity of the seabed. Then, the water of the suction chamber is again extracted in order to further move the cylindrical wall into the seabed. The piston is then still subjected to the hydrostatic pressure of the seabed, and the forces that it sustains are transmitted to the cylindrical wall. The piston may then be sequentially raised until the cylindrical wall is totally sunk.

Advantageously, said water-entry end has an opening corresponding substantially to the cross section of said cylindrical wall so that the other chamber which surmounts the suction chamber is initially filled with water and consequently the piston is subjected to the hydrostatic pressure.

In addition, said immobilization means preferably comprise a line, for example formed of a chain, connected to said piston and means for retaining said line in order to keep said line in a direction oriented from said water-entry end to said suction end. Therefore, said line, which extends above said piston to the water-entry end, is capable of being engaged in the retention means which, for their part, are secured to the cylindrical wall, so that the forces that are applied to the piston may be transmitted to said cylindrical wall via said line and the retention means.

In addition, said water-entry end has a path for the passage of said line in order to allow said line to extend out of said cylindrical wall. In this way, the movement of the piston toward the water-entry end is capable of being carried out by moving said line in translation in a direction away from the seabed, for example by means of a winch installed on a surface boat.

Preferably, said means for retaining said line are mounted on said cylindrical wall at said water-entry end, so that the piston may be moved from the suction end to the water-entry end over the whole length of the cylindrical wall. In this way, the whole of the cylindrical wall may be sucked into the seabed with the aid of the piston onto which the seabed hydrostatic pressure is applied.

In addition, said means for retaining said line comprise controllable locking means which make it possible alternately to unlock and relock said line gradually as the piston is raised to the water-entry end.

Advantageously, said pumping means are suitable for extracting the water from said one of said chambers through said piston in order to discharge it into said other chamber and create a negative pressure in said one of said chambers. To do this, they are for example installed on the piston. In addition, when the piston is raised to the water-entry end, the pumping means are deactivated and they allow water to enter the suction chamber.

In addition, said piston is advantageously fitted with a circular seal to provide the seal between said two opposite chambers.

Other features and advantages of the invention will emerge on reading the description given below of a particular embodiment of the invention, given as an indication but not being limiting, with reference to the appended drawings in which:

DESCRIPTION OF A PREFERRED EMBODIMENT

Figure 1:
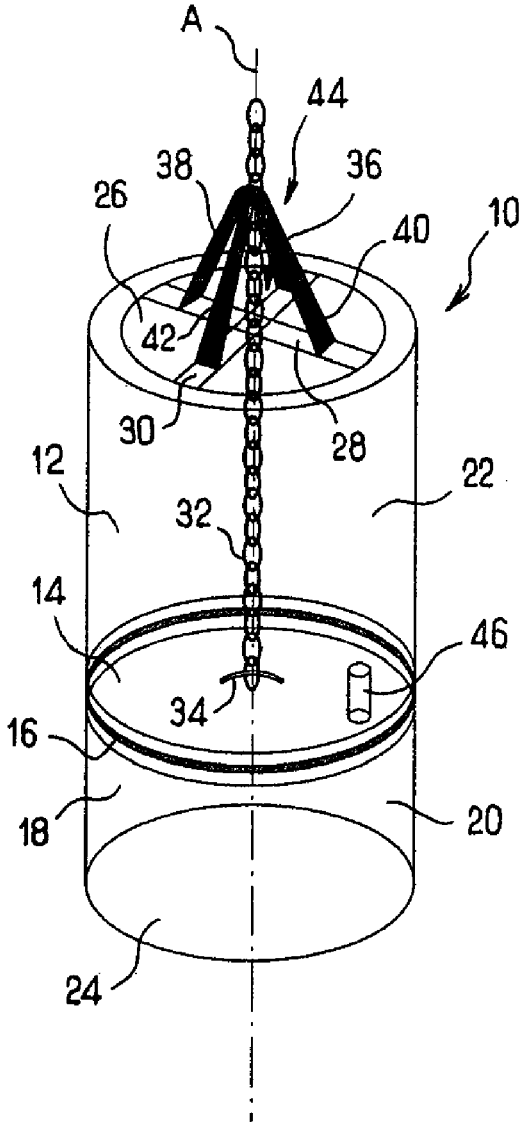
FIG. 1 is a schematic view in perspective of a suction pile according to the invention.

FIG. 1 illustrates a suction pile 10 according to the invention and designed to be sucked into a seabed. The suction pile 10 comprises a cylindrical wall 12 which extends longitudinally on a symmetrical axis A and in which a piston 14, that can be moved in translation on said axis of symmetry A, is mounted. The cylindrical wall 12 has for example a length of between 18 and 25 meters and a diameter of between 7 and 12 meters. The piston 14 delimits in a sealed manner, thanks to a seal 16 which surrounds it and which presses against an internal surface 18 of the cylindrical wall 12, two chambers sealed from one another, a lower suction chamber 20 and an upper opposite chamber 22. The seal 16 is for example an expandable seal whose expansion can be controlled by means of a pressurized fluid, for example with pressurized oil.

Furthermore, the cylindrical wall 12 has a lower suction end 24 which is open and an upper water-entry end 26 which is also open. The upper water-entry end 26 has in this instance two crossed structural members 28, which extend respectively on a diameter of the cylindrical wall 12 and which make it possible, if necessary, to suspend the cylindrical wall 12. However, the use of more than two structural members may then be necessary to support the cylindrical wall 12 precisely. In addition, the piston 14 is retained by a line 32 formed of a chain which extends from a loop 34 for coupling the piston 14 substantially on the axis of symmetry A in order to emerge from the cylindrical wall 12 through a path 36 made at the intersection of the structural members 28, 30. In addition, the retention means formed by four rods 38, 40, 42, 44 mounted opposite one another in twos and pivotingly onto the two structural members 28, 30 and which are suitable for clamping the chain 32 at a point situated on the axis of symmetry A, make it possible to immobilize it in translation toward the lower suction end 24. In this way, the piston 14 is then kept suspended inside the cylindrical wall 12. In addition, when the chain 32 is moved out of the cylindrical wall 12 in a direction away from the lower suction end 24 and above the upper water-entry end 26, the four rods 38, 40, 42, 44 are suitable for releasing said chain 32 in order to allow the piston 14 to rise toward the upper water-entry end 26. Advantageously, the rods 38, 40, 42, 44 are capable of being controlled by appropriate means not shown or by means of an underwater robot.

Furthermore, the piston 14 has a drill hole 46 which places the lower suction chamber 20 in communication with the opposite upper chamber 22, this drill hole 46 forming a duct and being surmounted by pumping means not shown in this FIG. 1.

Now, with reference to FIGS. 2 to 5, the method of using the suction pile 10 described above will be described.

Figure 2:
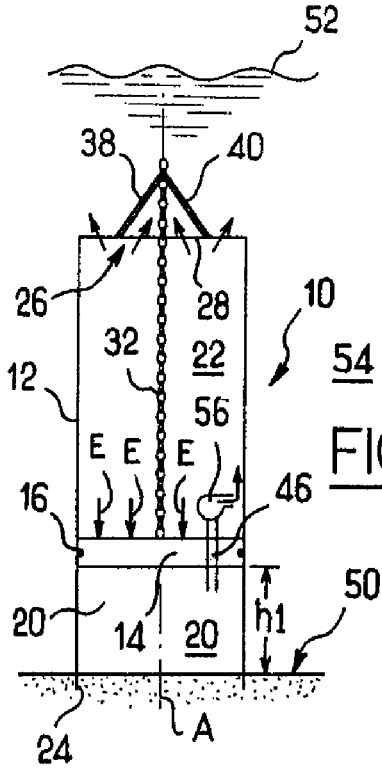
FIG. 2 is a schematic view in vertical section of the suction pile illustrated in FIG. 1 in a first phase of use.
Figure 3:
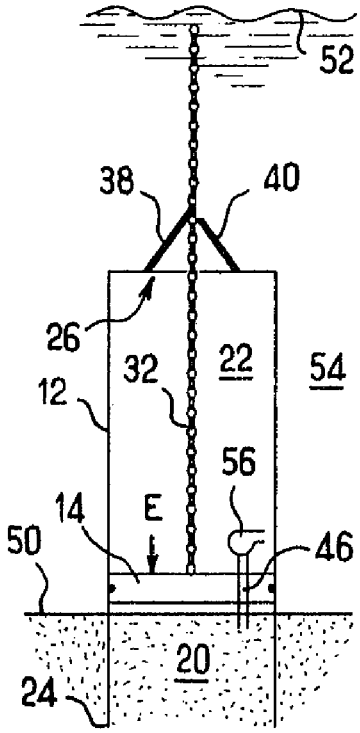
FIG. 3 is a schematic view in vertical section of the suction pile illustrated in FIG. 1 at the end of the first phase of use illustrated in FIG. 2.

In addition to the suction pile 10 that is there, FIG. 2 shows schematically a seabed 50 and, at the opposite end, a surface 52 corresponding to a certain depth of water 54 in which the suction pile 10 is immersed. The suction pile 10 is therefore resting vertically on the seabed 50 via its lower suction end 24 which is directly in contact with the sediments of the seabed 50. Furthermore, the piston 14 is then brought to a first height h1 which separates it from the seabed 50 by means of the chain 32 which is immobilized by means of the retention means 38, 40, 42, 44 of which only the rods 38 and 40 appear in the figure. This first height h1 corresponds to a depth of water H beneath the surface 52, at which depth of water H the hydrostatic pressure is sufficient. In addition, the upper water-entry end 26 allows the water to fill the opposite upper chamber 22 so that the piston 14 is subjected to the hydrostatic pressure that prevails close to the seabed 50 and which corresponds to said depth of water H. This hydrostatic pressure evidently decreases as the distance from the seabed 50 increases toward the surface 52. Therefore, the hydrostatic pressure that prevails close to the seabed 50 induces forces E on the piston 14 which are exerted in one direction, oriented from the surface 52 to the seabed 50, and which are transmitted to the cylindrical wall 12 via the chain 32, the retention means 38, 40, 42, 44 and the structural members 28, 30. According to another method of use of the invention not shown, means for immobilizing the piston 14 are formed by locks mounted movably on the piston and engaging in orifices made in the inner surface 18 of the cylindrical wall 12. In this way, said movable locks are suitable for immobilizing the piston 14 in translation relative to the cylindrical wall 12.

In addition, the drill hole forming a duct 46 is in this instance fitted with pumping means 56 which make it possible to suck the water contained in the lower suction chamber 20 in order to discharge it into the upper chamber 22 and create a negative pressure in the suction chamber 20 to cause the lower suction end 24 to sink into the seabed 50. This sinking for its part is greatly accelerated thanks to the forces E which are exerted on the piston 14 and consequently on the cylindrical wall 12 on the axis of symmetry A and toward the seabed 50.

Figure 4:
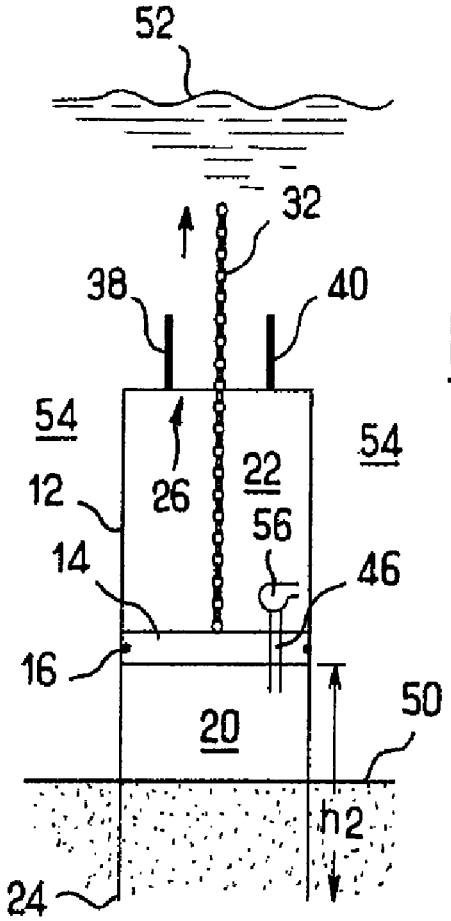
FIG. 4 is a schematic view in vertical section of the suction pile illustrated in FIG. 1 in a second phase of use.
Figure 5:
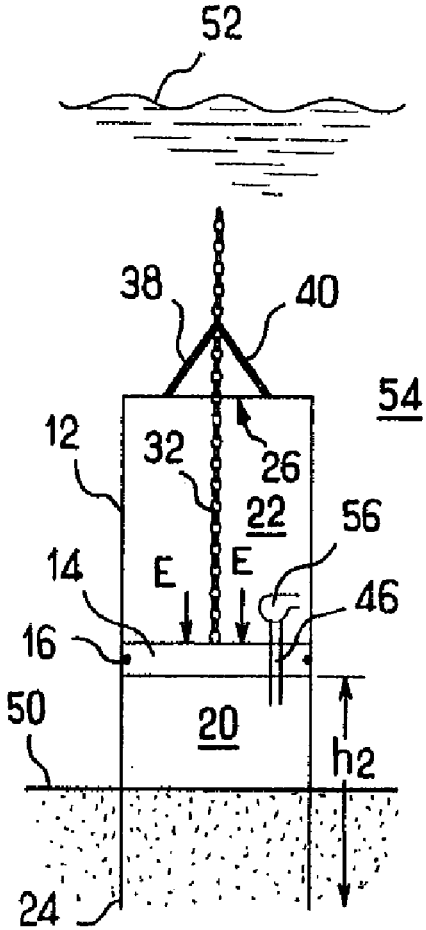
FIG. 5 is a schematic view in vertical section of the suction pile illustrated in FIG. 1 terminating said second phase of use.

When the cylindrical wall 12 has been sunk into the seabed 50 to a depth corresponding substantially to the initial height h1, the sediments substantially fill the lower suction chamber 20 to come in the end in contact with the lower wall of the piston 14. It is therefore understood that the forces E exerted on the piston 14 via the hydrostatic pressure of the seabed 50 will be reduced to zero when the lower suction chamber 20 is completely full of sediments. Therefore, and as illustrated in FIG. 4, the retention means 38, 40, 42, 44 are released. Then, after having deactivated the expandable seal 16, the chain 32 is pulled to the surface 52 in order to raise the piston 14 inside the cylindrical wall 12 by a height h2 corresponding substantially to the aforementioned depth of water H; the cylindrical wall 12 remains fixed in position since it is at least partially engaged in the seabed 50. During the raising of the piston 14, the drill hole 46 forming a duct is released so as to allow the water to enter the suction chamber 20. Then, when the height of the piston 14 is substantially equal to twice h1, the retention means 38, 40, 42, 44 are again locked in order to immobilize the chain 32 in translation, as illustrated in FIG. 5. The piston 14 is then again immobilized in translation toward the seabed 50 relative to the cylindrical body 12. And the operation for sucking water contained in the lower suction chamber 20 by means of the pumping means 56 will be able to restart to produce the same effects as aforementioned and to further sink the lower suction end 24 into the seabed. There again, with the piston 14 being subjected to forces associated with the hydrostatic pressure that prevails close to the seabed 50, forces that are absorbed by the chain 32 notably and transmitted to the cylindrical wall 12, the sinking thereof will thereby be made easier.

Therefore, when the lower suction chamber 20 is again full of sediments and the lower suction end 24 is sunk further into the seabed 50, the piston 14 will be able to be raised again for another suction operation. This can be continued until the cylindrical wall 12 is fully sunk into the seabed 50. The piston 14 for its part will then be situated close to the upper entry end 26.

The invention claimed is:

1. A suction pile configured to be sunk into a seabed surmounted with water, and the water has a seabed hydrostatic pressure in the vicinity of the seabed, the suction pile comprising a cylindrical wall, a piston within the wall and that is movable inside the cylindrical wall, the cylindrical wall having an open suction end configured to be sunk into the seabed, the piston delimiting in a sealed manner two opposite chambers, one of the chambers extends between the suction end and the piston and is configured to be filled with water when the suction end is placed against the seabed, the suction pile also comprising a pump configured for extracting water contained in the one chamber and for causing the suction end to sink into the seabed;

a device configured for immobilizing the piston relative to the cylindrical wall, while the cylindrical wall has a water-entry end opposite to the suction end relative to the piston, in order to allow entry of water at hydrostatic pressure into the other chamber;

the piston is alternatively immobilized and made to move from the suction end to the water-entry end gradually as the suction end is sunk in, so that the piston is subjected to the seabed hydrostatic pressure for causing the suction end to sink into the seabed.

2. The suction pile as claimed in claim 1, wherein the water-entry end has an opening corresponding substantially to a cross section of the cylindrical wall.

3. The suction pile as claimed in claim 1, wherein the immobilization device comprises a line connected to the piston and a retaining device for retaining the line in order to keep the line in a direction oriented from the water-entry end to the suction end.

4. The suction pile as claimed in claim 3, wherein the water-entry end has a path for the passage of the line in order to allow the line to extend out of the cylindrical wall.

5. The suction pile as claimed in claim 3, wherein the retaining device for retaining the line is mounted on the cylindrical wall at the water-entry end.

6. The suction pile as claimed in claim 3, wherein the retaining device for the line comprises a controllable locking device.

7. The suction pile as claimed in claim 1, wherein the pump is configured for extracting water from the one chamber through the piston in order to discharge the water into the other chamber to create a negative pressure in the one chamber.

8. The suction pile as claimed in claim 1, wherein the piston is fitted with a circular seal to provide the seal between the two opposite chambers.

* * * * *